US011248459B2

(12) United States Patent
Palmgren, III et al.

(10) Patent No.: US 11,248,459 B2
(45) Date of Patent: Feb. 15, 2022

(54) SELECTIVE AUTOMATED POWERING OF DOWNHOLE EQUIPMENT DURING RUN-IN-HOLE OPERATIONS

(71) Applicant: Halliburton Energy Services, Inc., Houston, TX (US)

(72) Inventors: Carl Albert Palmgren, III, Eufaula, OK (US); Ryan Bridwell Ashbaugh, Broken Arrow, OK (US); Mark Dale Stewart, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/830,940

(22) Filed: Mar. 26, 2020

(65) Prior Publication Data

US 2020/0332644 A1 Oct. 22, 2020

Related U.S. Application Data

(60) Provisional application No. 62/836,119, filed on Apr. 19, 2019.

(51) Int. Cl.
*E21B 47/008* (2012.01)
*E21B 47/12* (2012.01)

(52) U.S. Cl.
CPC ..... *E21B 47/008* (2020.05); *E21B 47/12* (2013.01)

(58) Field of Classification Search
CPC ..... E21B 47/008; E21B 47/12; E21B 43/128; E21B 47/13; E21B 23/08; E21B 23/14; E21B 43/00; E21B 43/03; E21B 23/04
See application file for complete search history.

(56) References Cited

U.S. PATENT DOCUMENTS 4,303,833 A * 12/1981 Eckel ..... E03B 3/06 290/1 R
6,254,353 B1 7/2001 Polo et al.
9,976,412 B2 5/2018 Shanks
(Continued)

FOREIGN PATENT DOCUMENTS

WO 2018075037 A1 4/2018

OTHER PUBLICATIONS

Groh, "Run-In-Hole Safety Assessment", Elsevier, ISBN 0-7506-4777-9, Explosion Protection, 2004, 5 pages.
(Continued)

*Primary Examiner* — Brad Harcourt
(74) *Attorney, Agent, or Firm* — Gilliam IP PLLC

(57) ABSTRACT

Selectively automating the powering of downhole equipment during run-in-hole (RIH) operations provides a means of safely installing and monitoring downhole equipment. Selective automation comprises monitoring lowering of a pump assembly into a borehole as part of an installation process. In response to determining that the lowering of the pump assembly into the borehole has stopped, an output of power from a power source to a cable coupled to the pump assembly is allowed. A data transmission is communicated from a downhole gauge in the pump assembly to a communication device at a surface of the borehole via the cable. In response to not receiving a valid data transmission at the communication device, it is determined that the cable may be damaged, and that further cable testing should occur.

20 Claims, 4 Drawing Sheets

(56) References Cited

U.S. PATENT DOCUMENTS

| | | | | |
|---|---|---|---|---|
| 2004/0188096 | A1* | 9/2004 | Traylor | E21B 43/128 166/369 |
| 2006/0213659 | A1* | 9/2006 | McCoy | E21B 47/00 166/250.01 |
| 2011/0050145 | A1 | 3/2011 | Plitt et al. | |
| 2014/0158380 | A1 | 6/2014 | Varkey et al. | |
| 2014/0216735 | A1* | 8/2014 | Bell | E21B 7/02 166/255.1 |
| 2015/0083399 | A1* | 3/2015 | Fripp | E21B 47/09 166/250.01 |
| 2016/0281479 | A1* | 9/2016 | Rendusara | E21B 43/128 |
| 2017/0089192 | A1* | 3/2017 | Rendusara | F04D 15/0077 |
| 2018/0112658 | A1* | 4/2018 | Fosmark | E21B 47/047 |

OTHER PUBLICATIONS

PCT Application Serial No. PCT/US2020/025089, International Search Report, dated Jul. 14, 2020, 4 pages.
PCT Application Serial No. PCT/US2020/025089, International Written Opinion, dated Jul. 14, 2020, 7 pages.

* cited by examiner

SELECTIVE AUTOMATED POWERING OF DOWNHOLE EQUIPMENT DURING RUN-IN-HOLE OPERATIONS

BACKGROUND

Downhole pumps are commonly used in oil and gas wells for producing large volumes of well fluid. A downhole pump is typically installed in a well by securing it to a string of production tubing and lowering the downhole pump assembly into the well. Power cables may be inadvertently damaged as the production string is lowered into the well. A damaged cable may expose power conductors, which in turn may contact grounded production tubing or wellhead material, causing an electrical short circuit.

Thus, conventional installation of a downhole motor and a downhole gauge frequently include periodic testing of downhole gauge data communications capability to ensure cable integrity. This testing often involves stopping the installation, manually connecting the gauge communication interface to the conductors of the cable, applying power to the downhole gauge via the cable, and establishing data communications with the downhole gauge. This periodic manual testing provides a level of confidence that the cable has not been damaged during the installation process thus far. However, these tests delay the process of adding production tubing, which increases installation costs.

BRIEF DESCRIPTION OF THE DRAWINGS

Embodiments of the disclosure may be better understood by referencing the accompanying drawings.

DESCRIPTION

Figure 1:
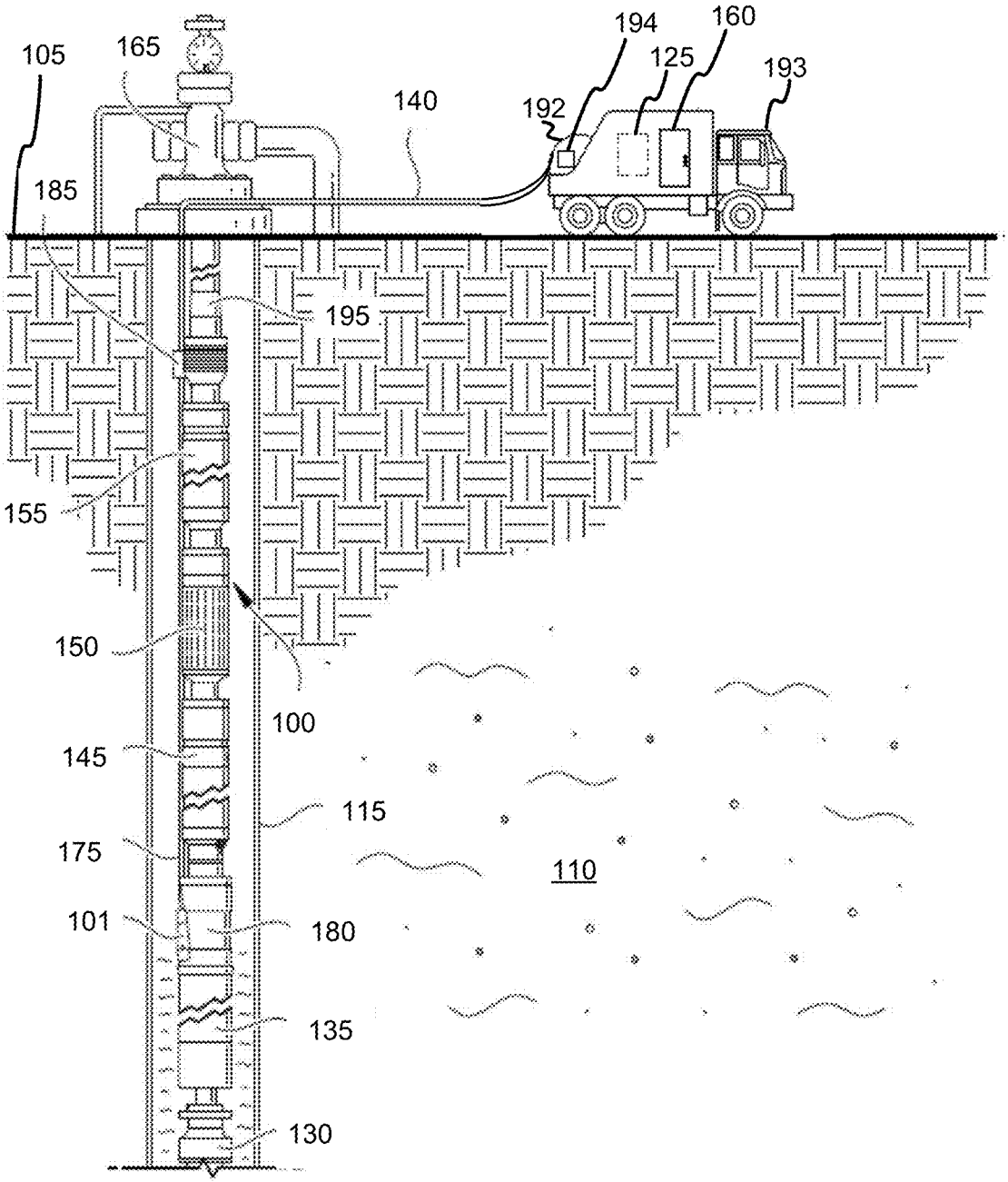
FIG. 1 depicts an example electrical submersible pump (ESP) assembly for downhole operations, according to some embodiments.

The description that follows includes example systems, methods, techniques, and program flows that embody aspects of the disclosure. However, it is understood that this disclosure may be practiced without these specific details. For instance, this disclosure refers to an ESP cable for providing power to an ESP motor in illustrative examples. Aspects of this disclosure can be also applied to other types of cables for downhole operations and to other configurations of motor and pump equipment installations. In other instances, well-known instruction instances, protocols, structures and techniques have not been shown in detail in order not to obfuscate the description.

Overview

Monitoring the condition of a cable during run-in-hole (RIH) operations utilizes a downhole gauge attached to a motor which is supplied power via the cable. The downhole gauge is utilized to detect cable damage by a loss of data communication with the gauge. A direct current (DC) voltage is applied via the cable to one or more downhole gauges. The downhole gauge modulates the electrical current flowing on the cable to convey its data to a surface interface. The surface interface monitors these current modulations and translates them into data values. An inductor within the downhole gauge provides isolation from high voltage spikes and from AC voltage imbalances during normal operation of a production string. The inductor provides this isolation by converting electrical current flow into stored magnetic energy within its core. This magnetic energy is dissipated into the cable as electrical energy when the DC current flow is interrupted. This energy can also be released as a spark when the energy discharges as a result of a short-circuit in the cable. The amount of energy released in this case is sometimes sufficient to ignite a flammable gas mixture present in the vicinity of the spark. To prevent this from occurring, the gauge should not be powered as the cable moves into a well.

Traditional methods for monitoring the condition of a cable during RIH operations involve manually connecting surface interface equipment to the cable to apply power to the downhole gauge and to establish data communications. Using periodic manual testing of the downhole gauge data communications can result in delayed discovery of damage to the cable because of the length of time between these periodic tests. Also, damage to the cable could go undiscovered for as long as the time needed to lower the production string into the well, for example 1,000 feet or more. This could translate into an additional hour or more of rig-time employed after the cable had already been damaged. A technique has therefore been developed to automate the cable-condition monitoring process to reduce the amount of potentially wasted time.

A device is configured to perform the automated technique for monitoring cable condition. The device controls power to a downhole gauge during installation using a microcontroller. The microcontroller executes instructions to control power to the downhole gauge and to establish data communications. The device also monitors current to determine the energy levels that exist on the cable. The device communicates the status of the downhole gauge communications and indicates possible downhole cable damage through wired or wireless methods. The device transmits communications status to spooler operators managing the installation process. The device may also transmit the communications status to other devices logging or monitoring the cable status and possible damage. The device periodically powers the downhole gauge, without user intervention, to establish data communications with the downhole gauge. Establishing data communications on a regular basis with a short timeframe, such as once per minute, provides a high level of confidence that the integrity of the downhole cable has been maintained. Significant damage to the downhole cable often prevents communication with the downhole gauge.

The device periodically powers the downhole gauge to test the downhole cable at a time when the downhole cable reel is not moving. Accelerometers and gyroscopes, as well as other known devices, sense cable reel rotation. Safety can be further enhanced by measuring the typical times between cable reel rotations and pre-emptively removing power from the cable, allowing the stored energy to discharge safely before the next anticipated or predicted cable reel rotation. A peripheral safety feature of the device is that the device includes a controller that controls power to the downhole gauge and that also monitors the electrical current levels as the controller safely discharges the inductor's stored energy. Monitoring the electrical current levels can be leveraged by conveying the current level status information via wired or wireless communication methods to equipment on the rig floor that controls the lowering of the production string into the well. This energy-level monitoring and status conveyance can serve as a permissive to the rig floor equipment such that lowering of the production string into the well is only permitted after the discharge current levels have dropped below a threshold defined as a safe level. The threshold is a limit to assure that the energy in the cable is not sufficient to cause a hazardous spark discharge if a short-circuit should develop. Thus, the automated technique provides safety benefits by preventing electrically generated sparks when the cable is damaged during installation. The timely recognition of cable damage, when downhole gauge communication cannot be established at the next pause in cable reel rotation, reduces risk and costs.

Example System

FIG. 1 depicts an example ESP assembly for downhole operations, according to some embodiments. An ESP assembly 100 is located downhole in a well below a surface 105. The well may, for example, be several hundred or a few thousand meters deep. The ESP assembly 100 is depicted as vertical, but it may also be horizontal or may be curved, bent and/or angled, depending on well direction. The well may be an oil well, water well, and/or well containing other hydrocarbons, such as natural gas, and/or another production fluid taken from an underground formation 110. The ESP assembly 100 is separated from the underground formation 110 by a well casing 115. Production fluid enters the well casing 115 through casing perforations (not shown). Casing perforations may be either above or below an ESP intake 150. The ESP assembly 100 includes, from bottom to top, a downhole gauge 130 which can include one or more sensors that can detect and provide information such as motor speed, internal motor temperature, pump discharge pressure, downhole flow rate and/or other operating conditions to a user interface, variable speed drive controller, and/or data collection computer, herein individually or collectively referred to as controller 160, on surface 105. An ESP motor 135 may comprise an induction motor, such as a two-pole, three phase squirrel cage induction motor. An ESP cable 140 provides power to the ESP motor 135 and/or carries data to and/or from the downhole gauge 130 to the surface 105.

At the surface 105, the ESP cable 140 is wound around a spool 192. The spool 192 is part of a spooler truck 193. The ESP cable 140 is coupled to a device 194 and a power source 125. The device 194 communicates with the downhole gauge 130 and controls the supply of power output from the power source 125 through the ESP cable 140. While depicted as separate devices, the device 194 may include, or be included within, the controller 160. The device 194 may comprise a battery-operated device that may include a microcontroller to execute instructions that control power to the downhole gauge 130.

Upstream of the ESP motor 135 is a motor protector 145, an ESP intake 150, an ESP pump 155 and a production tubing 195. The motor protector 145 may serve to equalize pressure and keep the motor oil separate from well fluid. The ESP intake 150 may include intake ports and/or a slotted screen and may serve as the intake to the ESP pump 155. The ESP pump 155 may comprise a multi-stage centrifugal pump including stacked impeller and diffuser stages. Other components of ESP assemblies may also be included in the ESP assembly 100, such as a tandem charge pump (not shown) or gas separator (not shown) located between the ESP pump 155 and the ESP intake 150 and/or a gas separator that may serve as the pump intake. Shafts of the ESP motor 135, the motor protector 145, the ESP intake 150 and the ESP pump 155 may be connected (i.e., splined) and rotated by the ESP motor 135. The production tubing 195 may carry lifted fluid from the discharge of the ESP pump 155 toward a wellhead 165.

The ESP cable 140 extends from the device 194 and the power source 125 at surface 105 to a motor lead extension (MLE) 175. A cable connection 185 connects the ESP cable 140 to the MLE 175. The MLE 175 may plug in, tape in, spline in or otherwise electrically connect the ESP cable 140 to the ESP motor 135 to provide power to the ESP motor 135. A pothead 101 encloses the electrical connection between MLE 175 and a head 180 of the ESP motor 135.

Example Operations

Figure 2:
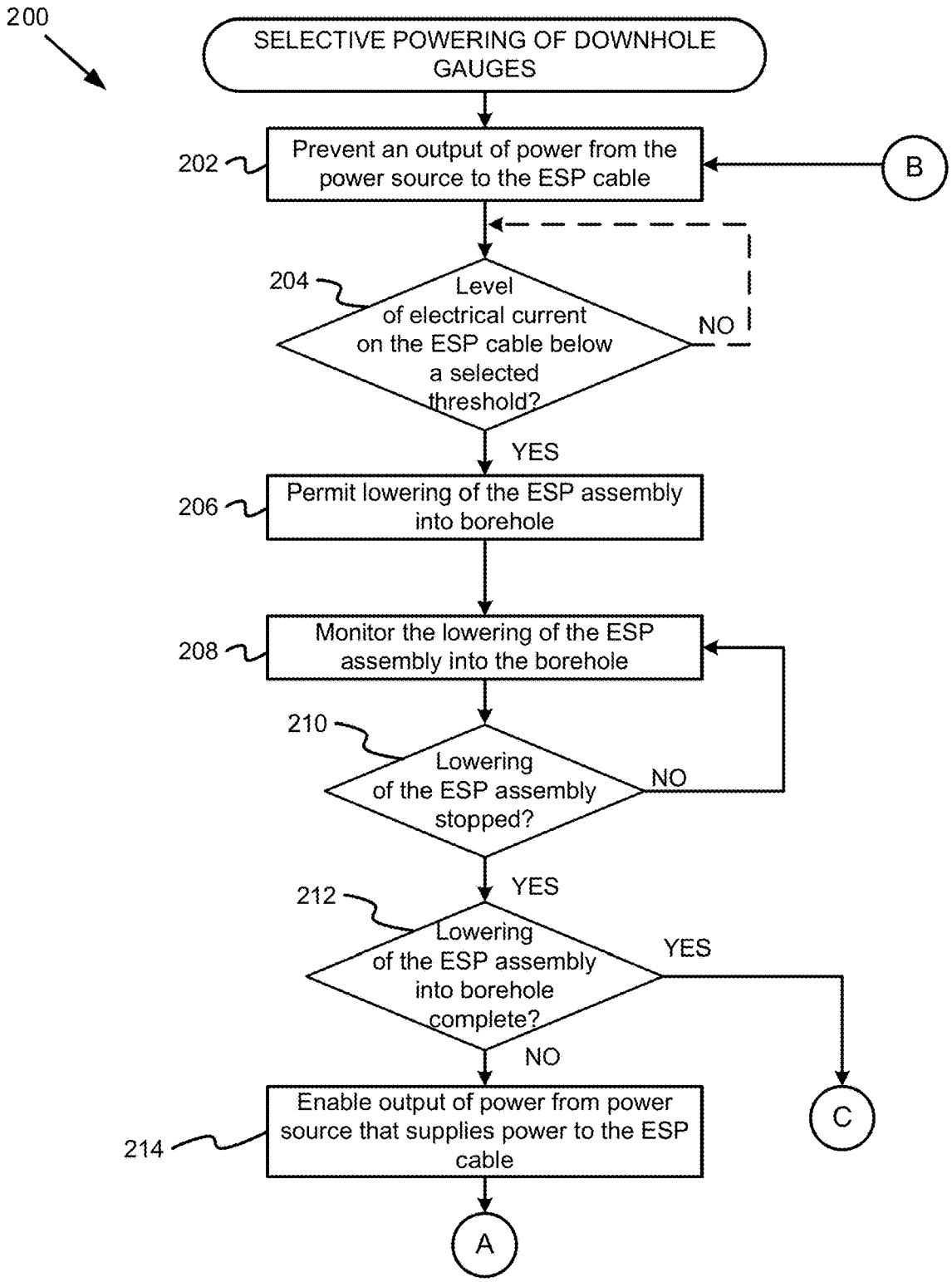
FIGS. 2-3 depict flowcharts of operations for selective powering of a downhole gauge, according to some embodiments.
Figure 3:
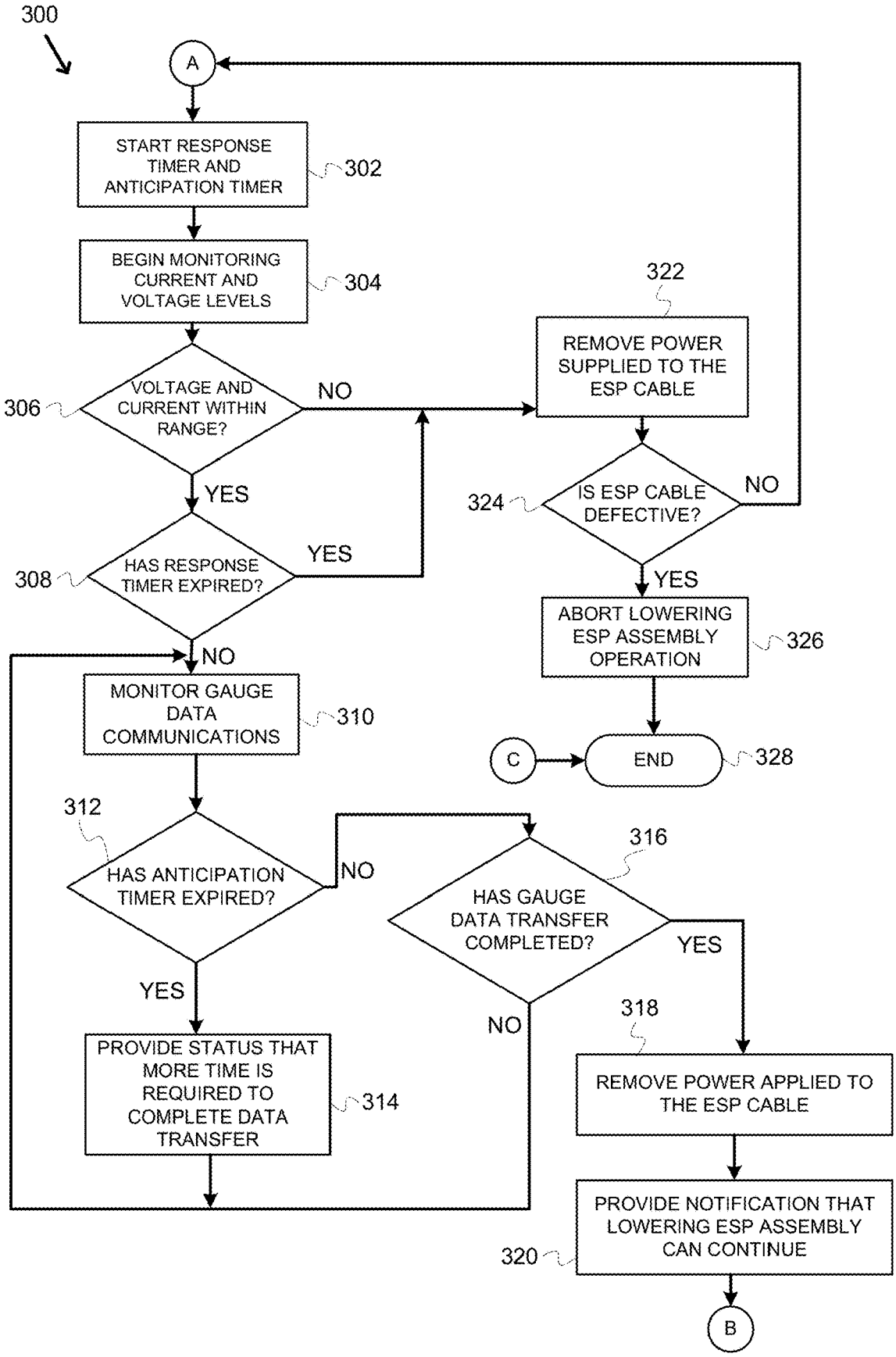

Example operations of selective powering of downhole equipment, including a downhole gauge, are now described. FIGS. 2-3 depict flowcharts of operations for selective powering of a downhole gauge, according to some embodiments. Operations of flowcharts 200-300 of FIGS. 2-3 are connected through transition points A-C. Operations of the flowcharts 200 and 300 can be performed by software, firmware, hardware or a combination thereof. The description refers to the program codes that perform operations as a "power control operator" and a "communication program" although it is appreciated that program code naming and organization can be arbitrary, language dependent, and/or platform dependent. The operations of the flowchart 200 start at block 202.

At block 202, an output of power from the power source to the ESP cable is prevented. An ESP assembly is coupled via an ESP cable to a power source and a device at the surface of a borehole. The device comprises a microcontroller that executes instructions of a power control operator to control power to the downhole gauge. The power control operator prevents an output of power to begin monitoring downhole communications and cable conditions. Preventing an output of power from the power source to the ESP cable prevents a downhole inductor from storing magnetic energy and allows time for stored energy to discharge.

At block 204, a determination is made as to whether the level of the electrical discharge current on the ESP cable is below a threshold value. The power control operator receives data indicating the level of electrical discharge on the ESP cable. The threshold value may be selected from a set of threshold values based upon predefined safety standards and/or operating conditions of an ESP assembly. If the level of the electrical discharge current on the ESP cable is above the selected threshold, then a next evaluation at block 204 is made after a delay corresponding to an expiration of a specified time period and/or an explicit command is detected. This delay (depicted with a dashed line) allows the level of the electrical current to drop. Otherwise, operations of the flowchart 200 continue at block 206.

At block 206, the ESP assembly is permitted to be lowered into the borehole. Based on the determination that the electrical discharge current is below the selected threshold, the power control operator sends a signal to the equipment that controls lowering the production string into the well. The signal is a permissive that only allows lowering of the ESP assembly when the discharge current levels have dropped to a safe level where there is not sufficient energy in the ESP cable to cause a hazardous spark discharge.

At block 208, the lowering of the ESP assembly into the borehole is monitored. The device includes one or more motion sensors in communication with the power control operator to detect motion of the spool that is used to lower the ESP assembly. The device may be mounted within a central hub of the spool. The device incorporates or communicates with accelerometers and/or gyroscopes to sense ESP cable spool motion. The motion sensors may communicate spool motion to the power control operator continuously, periodically, or when a change in motion is detected (i.e. a stop or start). As long as sensors detect spool motion, the power control operator will prevent an output of power from the power source.

At block 210, a determination is made as to whether lowering of the ESP assembly down the borehole has stopped. The power control operator analyzes the received signals from the motion sensors to determine if the spool is in motion. If the lowering of the ESP assembly downhole has not stopped, operations of the flowchart 200 return to block 208 to continue monitoring. Otherwise, operations of the flowchart 200 continue at block 212.

At block 212, a determination is made as to whether lowering of the ESP assembly into the borehole is complete. When the power control operator receives data indicating the lowering of the ESP assembly has stopped, the power control operator determines that the lowering of the ESP assembly is complete. For continuous communication between the power control operator and the motion sensors, the determination may be based on receiving data that the lowering has stopped for a set period of time. The determination may also be made based on known well conditions, such as depth and orientation, and/or the length of cable released from the spool, and/or operator intervention. If lowering of the ESP assembly into the borehole is not complete, operations of the flowchart 200 continue at block 214. If lowering of the ESP assembly into the borehole is complete, operations of the flowchart 200 continue at transition point C, in FIG. 3, where operations are considered complete.

At block 214, an output is enabled from the power source that supplies power to the ESP cable. The power control operator controls the power supplied to the gauge to establish data communications from the gauge to the device. A communication program, as part of a communication device, monitors gauge operating current to detect data communication from the downhole gauge.

Operations of the flowchart 300 are now described. From transition point A in FIG. 2, operations of the flowchart 300 in FIG. 3 continue at block 302. This transition point is a transition between actors as well as operations in time.

At block 302, a response timer and an anticipation timer are started when power is supplied to the downhole gauge. The downhole gauge begins modulating its operating current when power is applied to synchronize a transmitter and a receiver of the downhole gauge. After synchronization, the downhole gauge begins to transmit data to the surface. The communication program includes or manages the response timer and the anticipation timer. The response timer establishes a response time within which the downhole gauge is to respond, or transmit data, before the expiration of the established time. If the downhole gauge does not respond prior to expiration of the response time, the integrity of the ESP cable can be deemed suspect and lowering the ESP assembly can be suspended until the cause of the downhole gauge not responding has been resolved. A data transmission packet is typically validated after it is completely received. Damage to the ESP cable typically exhibits itself by high DC operating current on the ESP cable, very low operating voltage on the ESP cable, and no synchronization-pulse signals (data transmission signals follow the synchronization pulses). The anticipation timer measures a time, the anticipation time, after which it is anticipated that the ESP assembly will be lowered. The anticipation timer may count down from a pre-determined anticipation time or it may be a running counter that is used to measure the elapsed times corresponding to the response timer and the anticipation timer. Expiration of the anticipation timer occurs with the next expected movement of the production string into the well. Gauge data transmissions should be completed before this anticipation timer expires. The electrical current levels on the cable are reduced to below the safety threshold before the next anticipated production string lowering. The response timer typically has a shorter time than the anticipation timer. The response time is the time within which the surface device should recognize that the supply voltage to the cable is within proper limits, the operating current is within proper limits, and the current modulations from the gauge are recognized and are within their proper limits. Once these conditions are all met, expiration of the response timer may be ignored. For example, recognition of any cable damage may be apparent within twenty seconds by lower than normal supply voltage on the cable, higher than normal gauge operating current, the lack of sync pulses, and/or no data transmission pulses received. While described as separate timers, the response timer and the anticipation timer may be combined into a single timer. Embodiments using a single combined timer may start the timer and have different expiration times set for the anticipation time and the response time. The length of the anticipation timer may be adaptive in its nature to the cyclical rhythm of the installation process.

At block 304, at least one electrical sensor of the device at the surface of the borehole begins monitoring the voltage and current levels. The sensor monitors initial DC voltage and DC current levels applied to the ESP cable. The current monitoring functions are used to establish energy levels available on the ESP cable. A single sensor may be used to monitor both voltage and current or separate sensors may be used for each measurement. The downhole gauge communicates data by modulating its operating current. The surface device monitors the operating current modulations through the sensor and decodes current modulations as data. Damage to the ESP cable is typically recognized by an electrical short-circuit to ground of the DC voltage used to supply power to the downhole gauge.

At block 306, a determination is made as to whether the voltage and current are within defined ranges. The power control operator interprets the current and voltage level measurements. Based on the measurements, the power control operator determines if a valid response is detected. A valid response includes proper DC voltage levels and DC current modulations to indicate the gauge is powered and operating as expected. If the voltage and current are not within the defined ranges, operations of the flowchart 300 continue at block 322. Otherwise, operations of the flowchart 300 continue at block 308.

At block 308, a communication program determines whether the response timer has expired. The communication program resides in a device mounted in the center of the spool while it rotates. If the response time has expired, operations of the flowchart 300 continue at block 322. Otherwise, operations of the flowchart 300 continue at block 310.

At block 310, the device begins monitoring the downhole gauge data communications using the communication program. The device communicates, perhaps wirelessly, the status of the downhole gauge communications to spooler operators.

At block 312, the communication program determines whether the anticipation timer has expired. In some embodiments, the next anticipated lowering can be based on empirical evidence that is specific to the personnel involved in the lowering operation, the location of the borehole, or the type of formation into which the borehole was drilled. For an example with reference to FIG. 1, personnel A, on average, may be able to attach additional production tubing 195 at the surface in time X, while personnel B, on average, may be able to attach additional production tubing at the surface in time Y. Accordingly, the time threshold for personnel A can be time X, or time X minus some initial ramp-up time. Similarly, the time threshold for personnel B can be time Y, or time Y minus some initial ramp-up time. These thresholds, such as X and Y, can be used to establish the anticipation time. When the anticipation timer has expired, operations of the flowchart 300 continue at block 314. Otherwise, operations of the flowchart 300 continue at block 316.

At block 314, if the anticipation timer expires before the completion of the downhole communications as determined by communication program, a status is provided that more time is required to complete the data transfer. A status that more time is needed to complete the data transfer indicates a gauge data transfer has not been completed. Operations of the flowchart return to block 310. Blocks 310, 312, and 314 are repeated until the communication program determines more time is not required to complete the data transfer.

At block 316, the communication program determines whether the downhole gauge data transfer is complete. If the downhole gauge data transfer is not complete, operations of the flowchart 300 return to block 310. Otherwise, operations of the flowchart 300 continue at block 318. The power control operator continues to supply power to the ESP cable while the communication program determines the status of the gauge data transfer, and the next anticipated cable reel rotation is prevented. The operations return to block 310. Operations of blocks 310, 312, 314, and 316 are repeated until the gauge data transfer is complete. This gauge data transfer completion status may be conveyed from the communication program to the power control operator via wireless communication, or other means. The communication program may also convey the data to spooler operators managing the ESP installation process, rig floor personnel, or others in the vicinity monitoring the progress of the ESP installation through a wireless network interface.

At block 318, power applied to the ESP cable is removed. The power control operator controls the power supply to terminate the power to the ESP cable. Gauge data communications are completed prior to the expiration of the anticipation timer. Upon completion of the gauge data communications, the power control operator removes power supplied to the ESP cable. The electrical energy levels in the ESP cable dissipate over time after the power is removed from the ESP cable.

At block 320, the power control operator provides a notification to the spooler operators that lowering the ESP assembly is permitted to continue. Once the electrical energy levels on the ESP cable have dissipated below a safety threshold value, a permissive is granted. The permissive acts to change the status of the notification to safety operators to allow the ESP assembly to resume movement into the borehole. Operations continue at transition point B, which continues at transition point B of the flowchart 200 in FIG. 2.

At block 322, a failure of the DC voltage to rise to an expected level or an excess of DC current (determined at block 306) indicates a possible ESP cable fault condition. Power supplied to ESP cable is removed in either case, as well as when the response timer has expired (at block 308).

At block 324, the ESP cable integrity is evaluated. The RIH operation is suspended until the cable spool operator performs tests to determine whether the ESP cable is defective. If the ESP cable passes the manual tests performed by the cable spool operator, the cable is not defective, and operations continue at transition point A (at block 302). If the manual tests performed by the cable spool operator on the ESP cable fail, the cable is determined to be defective, and the ESP cable operation continues at block 326.

At block 326, lowering the ESP assembly operation is aborted. Operations of the flowchart 300 are then complete.

The flowcharts of FIGS. 2 and 3 may be performed by a device that includes circuitry and measurement devices, such as accelerometers and/or gyroscope components that sense and respond to physical motion, such as the direction of gravity or rotation. A processor or microcontroller with appropriate software or firmware can act upon this response to provide status information and data relating to the physical motion via wireless communication, or other means, to remote devices in the vicinity, so that rig floor operators, and other personnel monitoring the installation progress, can become aware of the cable condition, such as when a spool rotates to lower the ESP cable downhole, or when the cable reel has stopped rotating. The device may also include a web interface that serves the downhole gauge data and communication status to various devices (e.g., mobile devices, computers, etc.). Some embodiments may include a device that provides a go/no-go status indicator for the rig floor personnel and an electrical permissive that may disable lowering the production string until electrical energy levels on the cable are below a safety threshold defined so that the process of lowering the production string into the well is considered appropriate. Thus, various embodiments can provide an increase in safety and a cost savings over conventional approaches.

Example Computer

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a RAM, a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Using the apparatus, systems, and methods disclosed herein may provide the ability to more efficiently conduct downhole operations, including operations that involve ESP motors and cables.

Figure 4:
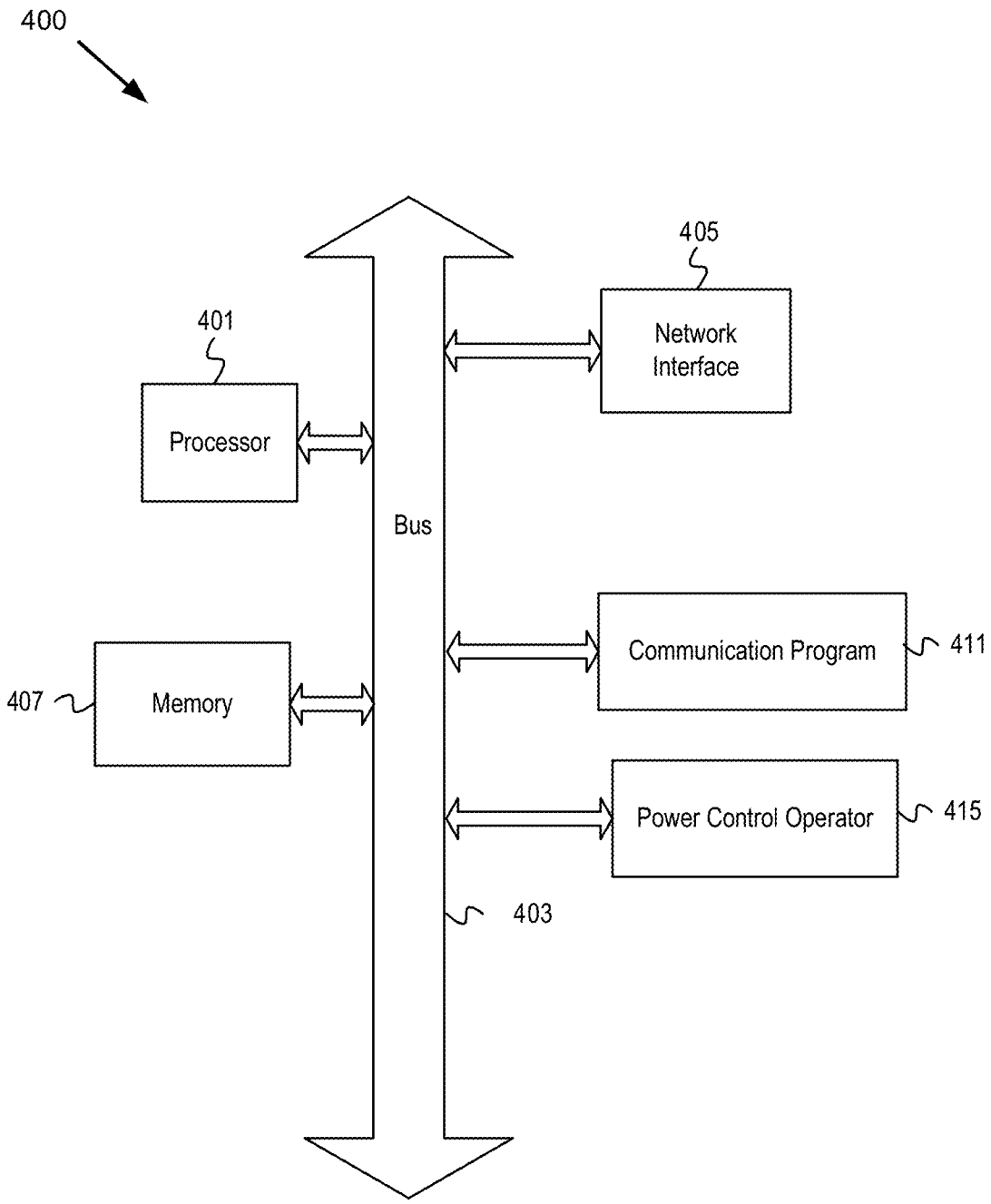
FIG. 4 depicts an example computer, according to some embodiments.

FIG. 4 depicts an example computer, according to some embodiments. The computer 400 includes a processor 401 (possibly including multiple processors, multiple cores, multiple nodes, and/or implementing multi-threading, etc.). The computer 400 includes memory 407. The memory 407 may comprise system memory or any one or more of the above already described possible realizations of machine-readable media. The computer 400 also includes a bus 403 and a network interface 405. In some embodiments, the network interface 405 may comprise a wireless network interface to communicate data and its status to other wireless devices in the vicinity. In some embodiments, the computer 400 can include a separate microcontroller, perhaps as part of a communication program 411 that sends signals to the power control operator 415 to control the application of Direct Current (DC) power for the downhole gauge through the ESP cable. The microcontroller can include different types of machine-readable media. For example, the microcontroller can include embedded memory to store its program and data along with random access memory.

The computer 400 thus includes the communication program 411 and may also include a power control operator 415. The communication program 411 can perform communication status determination operations, as described above. The power control operator 415 can control the different operations that can occur in response to the selective power operations. For example, the power control operator 415 can communicate instructions to the appropriate equipment, devices, etc. to alter or abort the downhole operations, including movement of the ESP cable. Any one of the previously described functionalities may be partially (or entirely) implemented in hardware and/or on the processor 401. For example, the functionality may be implemented with an application specific integrated circuit, in logic implemented in the processor 401, in a co-processor on a peripheral device or card, etc. Further, realizations may include fewer or additional components not illustrated in FIG. 4 (e.g., video cards, audio cards, additional network interfaces, peripheral devices, etc.). The processor 401 and the network interface 405 are coupled to the bus 403. Although illustrated as being coupled to the bus 403, the memory 407 may be coupled to the processor 401.

It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus for execution to implement the various methods described above.

While the aspects of the disclosure are described with reference to various implementations and exploitations, it will be understood that these aspects are illustrative and that the scope of the claims is not limited to them. In general, techniques for ESP installation and monitoring as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Examples Embodiments

A method comprises monitoring lowering of a pump assembly into a borehole and preventing an output of power from a power source to a cable coupled to the pump assembly while the pump assembly is lowered. In response to determining that the pump assembly has stopped, the method further comprises allowing the output of power from the power source to the cable coupled to the pump assembly, monitoring the cable for one or more data transmissions from a downhole gauge in the pump assembly, and determining whether the cable is damaged based, at least in part, on the data transmission monitoring.

The method further comprises monitoring voltage and current on the cable in response to allowing the output of power from the power source to the cable, determining whether voltage and current measured on the cable are within a safe range, and terminating the output of power to the cable based on a determination that the voltage and current measurements are not within the safe range.

The method further comprises initiating a first timer based on monitoring the cable for data communications from the downhole gauge and terminating the output of power to the cable based on expiration of the first timer. The first timer corresponds to a time for the downhole gauge to begin a data communication.

The method further comprises initiating a second timer based on allowing supplying of power and generating a notification that more time for data communications from the downhole gauge is needed, wherein the second timer corresponds to an anticipated time of lowering and securing the next length of production tubing.

The method further comprises preventing an output of power from the power source to the cable based on a determination that the pump assembly is moving.

Monitoring the cable for one or more data transmissions from the downhole gauge comprises determining an operating current, voltage and/or synchronization-pulse or data signals on the cable, wherein determining whether the cable is damaged based on the data transmission monitoring comprises determining that the cable is damaged based on a determination that the operating current is high, the voltage is low, and/or there are no synchronization-pulse or data signals.

The method further comprises determining whether electrical current on the cable is below a safety threshold before allowing the pump assembly to be moved. The safety threshold at least corresponds to a predetermined level of electrical current on the cable.

Monitoring the lowering of the pump assembly comprises monitoring motion of a spool that contains the cable that is lowered into the borehole.

A system comprises a pump assembly including a downhole gauge, a power source, a spool to hold at least a portion of a cable, a processor, and a computer-readable medium having instructions stored thereon that are executable by the processor to cause the system to monitor lowering of a pump assembly into a borehole and prevent an output of power from a power source to a cable coupled to the pump assembly while the pump assembly is lowered. In response to determining that the pump assembly has stopped, the instructions further cause the system to allow an output of power from the power source to the cable coupled to the pump assembly, monitor the cable for one or more data transmissions from a downhole gauge in the pump assembly, and determine whether the cable is damaged based, at least in part, on the data transmission monitoring.

The system further comprises instructions to determine whether voltage and current measured on the cable are within a safe range and terminating the output of power to the cable based on a determination that voltage or current measured on the cable are not within a safe range.

The system further comprises instructions to monitor voltage and current on the cable in response to allowing the output of power from the power source to the cable.

The system further comprises instructions to initiate a first timer based on monitoring the cable for data communications from the downhole gauge and terminating the output of power to the cable based on expiration of the first timer. The first timer corresponds to a time for the downhole gauge to begin sending a data communication.

The system further comprises instructions to initiate a second timer based on allowing the output of power and generate a notification that more time for data communications from the downhole gauge is needed. The second timer corresponds to an anticipated time for the next cycle to begin lowering the pump assembly in the borehole.

The system further comprises instructions to prevent an output of power from the power source to the cable based on a determination that the pump assembly is moving.

A non-transitory, computer-readable medium having instructions stored thereon that are executable by a computing device to perform operations comprises monitoring lowering of a pump assembly into a borehole and preventing an output of power from a power source to a cable coupled to the pump assembly while the pump assembly is lowered. In response to determining that the pump assembly has stopped moving, the device performs operations comprising allowing the output of power from the power source to the cable coupled to the pump assembly, monitoring the cable for one or more data transmissions from a downhole gauge in the pump assembly, and determining whether the cable is damaged based, at least in part, on the data transmission monitoring.

The operations further comprise monitoring voltage and current on the cable in response to allowing an output of power from the power source to the cable and determining whether voltage and current measured on the cable are within a safe range and terminating the output of power to the cable based on a determination that the voltage and current measurements are not within a safe range.

The operations further comprise initiating a first timer based on monitoring the cable for data communications from the downhole gauge and terminating the output of power to the cable based on expiration of the first timer. The first timer corresponds to time for the downhole gauge to initiate a data communication.

The operations further comprise initiating a second timer based on anticipating the next movement of the ESP assembly into the borehole, monitoring the downhole gauge data communications to determine whether data communications are complete, and terminating the output of power prior to the anticipated next movement of the ESP assembly into the borehole.

In response to determining the data communications are incomplete, the operations further comprise extending the expiration of the second timer and delaying the termination of the output of power.

In response to determining the data communications are complete, the operations further comprise providing a status to operators and other remote personnel and systems of the readiness to permit moving the ESP assembly into the borehole and permitting movement of the ESP assembly into the borehole based upon its readiness status.

What is claimed is:

1. A method comprising:

monitoring lowering of a pump assembly into a borehole;

preventing an output of power from a power source to a cable coupled to the pump assembly while the pump assembly is being lowered into the borehole and is moving; and in response to determining that the lowering of the pump assembly into the borehole is stopped and that the lowering of the pump assembly into the borehole is not complete, the method further comprising:

allowing the output of power from the power source to the cable coupled to the pump assembly;

monitoring the cable for one or more data transmissions from a downhole gauge in the pump assembly; and determining whether the cable is damaged based, at least in part, on the data transmission monitoring.

2. The method of claim 1, further comprising:

monitoring voltage and current on the cable in response to allowing the output of power from the power source to the cable;

determining whether voltage and current measured on the cable are within a safe range; and terminating the output of power to the cable based on a determination that the voltage and current measurements are not within the safe range.

3. The method of claim 1, further comprising:

initiating a first timer based on monitoring the cable for data communications from the downhole gauge; and terminating the output of power to the cable based on expiration of the first timer, wherein the first timer corresponds to a time for the downhole gauge to begin a data communication.

4. The method of claim 3, further comprising:

initiating a second timer based on allowing supplying of power; and generating a notification that more time for data communications from the downhole gauge is needed, wherein the second timer corresponds to an anticipated time of lowering and securing the next length of production tubing.

5. The method of claim 1, further comprising preventing an output of power from the power source to the cable based on a determination that the pump assembly is moving.

6. The method of claim 1, wherein monitoring the cable for one or more data transmissions from the downhole gauge comprises determining an operating current, voltage and/or synchronization-pulse or data signals on the cable, wherein determining whether the cable is damaged based on the data transmission monitoring comprises determining that the cable is damaged based on a determination that the operating current is high, the voltage is low, and/or there are no synchronization-pulse or data signals.

7. The method of claim 1, further comprising: determining whether electrical current on the cable is below a safety threshold before allowing the pump assembly to be moved, wherein the safety threshold at least corresponds to a predetermined level of electrical current on the cable.

8. The method of claim 1, wherein monitoring the lowering of the pump assembly comprises monitoring motion of a spool that contains the cable that is lowered into the borehole.

9. A system comprising:

a pump assembly including a downhole gauge;

a power source;

a spool to hold at least a portion of a cable;

a processor; and a computer-readable medium having instructions stored thereon that are executable by the processor to cause the system to, monitor lowering of a pump assembly into a borehole;

prevent an output of power from a power source to a cable coupled to the pump assembly while the pump assembly is being lowered into the borehole and is moving; and in response to determining that the lowering of the pump assembly into the borehole is stopped and that the lowering of the pump assembly into the borehole is not complete, the instructions that are executable by the processor are further configured to cause the system to:

allow an output of power from the power source to the cable coupled to the pump assembly;

monitor the cable for one or more data transmissions from a downhole gauge in the pump assembly; and determine whether the cable is damaged based, at least in part, on the data transmission monitoring.

10. The system of claim 9, further comprising instructions to: determine whether voltage and current measured on the cable are within a safe range and terminating the output of power to the cable based on a determination that voltage or current measured on the cable are not within a safe range.

11. The system of claim 9, further comprising instructions to: monitor voltage and current on the cable in response to allowing the output of power from the power source to the cable.

12. The system of claim 9, further comprising instructions to: initiate a first timer based on monitoring the cable for data communications from the downhole gauge and terminating the output of power to the cable based on expiration of the first timer, wherein the first timer corresponds to a time for the downhole gauge to begin sending a data communication.

13. The system of claim 12, further comprising instructions to: initiate a second timer based on allowing the output of power and generating a notification that more time for data communications from the downhole gauge is needed, wherein the second timer corresponds to an anticipated time for the next cycle to begin lowering the pump assembly in the borehole.

14. The system of claim 9, further comprising instructions to: prevent an output of power from the power source to the cable based on a determination that the pump assembly is moving.

15. A non-transitory, computer-readable medium having instructions stored thereon that are executable by a computing device to perform operations comprising:

monitoring lowering of a pump assembly into a borehole;

preventing an output of power from a power source to a cable coupled to the pump assembly while the pump assembly is being lowered into the borehole and is moving; and in response to determining that the lowering of the pump assembly into the borehole is stopped and that the lowering of the pump assembly into the borehole is not complete, the instructions that are executable by the computing device include instructions to perform further operations comprising:

allowing the output of power from the power source to the cable coupled to the pump assembly;

monitoring the cable for one or more data transmissions from a downhole gauge in the pump assembly; and determining whether the cable is damaged based, at least in part, on the data transmission monitoring.

16. The non-transitory, computer-readable medium of claim 15, wherein the operations further comprise: monitoring voltage and current on the cable in response to allowing an output of power from the power source to the cable; and determining whether voltage and current measured on the cable are within a safe range and terminating the output of power to the cable based on a determination that the voltage and current measurements are not within a safe range.

17. The non-transitory, computer-readable medium of claim 15, wherein the operations further comprise: initiating a first timer based on monitoring the cable for data communications from the downhole gauge and terminating the output of power to the cable based on expiration of the first timer, wherein the first timer corresponds to time for the downhole gauge to initiate a data communication.

18. The non-transitory, computer-readable medium of claim 17, wherein the operations further comprise: initiating a second timer based on anticipating the next movement of the ESP assembly into the borehole; monitoring the downhole gauge data communications to determine whether data communications are complete; and terminating the output of power prior to the anticipated next movement of the ESP assembly into the borehole.

19. The non-transitory, computer-readable medium of claim 18, wherein the operations further comprise: in response to determining the data communications are incomplete, extending the expiration of the second timer; and delaying the termination of the output of power.

20. The non-transitory, computer-readable medium of claim 18, wherein the operations further comprise: in response to determining the data communications are complete, providing a status to operators and other remote personnel and systems of the readiness to permit moving the ESP assembly into the borehole; and permitting movement of the ESP assembly into the borehole based upon its readiness status.

* * * * *